US009318789B1

(12) United States Patent
Henrich et al.

(10) Patent No.: US 9,318,789 B1
(45) Date of Patent: Apr. 19, 2016

(54) SELF-LEVELING ANTENNA WITH ANTENNA SUSPENDED IN LIQUID

(71) Applicant: Google Inc., Mountain View, CA (US)

(72) Inventors: Mitchell Joseph Henrich, Mountain View, CA (US); Brian Wasson, Mountain View, CA (US)

(73) Assignee: Google Inc., Mountain View, CA (US)

( * ) Notice: Subject to any disclaimer, the term of this patent is extended or adjusted under 35 U.S.C. 154(b) by 212 days.

(21) Appl. No.: 14/077,280

(22) Filed: Nov. 12, 2013

(51) Int. Cl.
*H01Q 1/24* (2006.01)
*H01Q 1/12* (2006.01)

(52) U.S. Cl.
CPC ..... *H01Q 1/12* (2013.01)

(58) Field of Classification Search
CPC ..... H01Q 1/125; H01Q 1/243
USPC ..... 343/702, 709
See application file for complete search history.

(56) References Cited

U.S. PATENT DOCUMENTS

| | | | | |
|---|---|---|---|---|
| 3,441,936 | A | 4/1969 | Heine | |
| 5,990,846 | A * | 11/1999 | Dichter | 343/872 |
| 6,697,026 | B1 | 2/2004 | Hemmingsen, II | |
| 2002/0084935 | A1 * | 7/2002 | Macias | 343/702 |
| 2008/0036665 | A1 * | 2/2008 | Schadler | 343/700 MS |

FOREIGN PATENT DOCUMENTS

| | | |
|---|---|---|
| JP | 7176932 | 7/1995 |
| JP | 11157480 | 6/1999 |

* cited by examiner

*Primary Examiner* — Hoanganh Le
(74) *Attorney, Agent, or Firm* — McDonnell Boehnen Hulbert & Berghoff LLP

(57) ABSTRACT

The present disclosure provides a device for providing connectivity to a balloon network. The device may include a sealed vessel partially filled with a liquid. The device may also include a floating base that is comprised of a material that is positively buoyant in the liquid. The device may also include an antenna coupled to the floating base. The antenna may be configured to receive and emit radiation. The antenna and the floating base may be positioned within the sealed vessel, and the floating base may be configured to position the antenna such that the antenna emits an emission pattern that is substantially perpendicular to a surface of the liquid.

18 Claims, 10 Drawing Sheets

SELF-LEVELING ANTENNA WITH ANTENNA SUSPENDED IN LIQUID

BACKGROUND

Unless otherwise indicated herein, the materials described in this section are not prior art to the claims in this application and are not admitted to be prior art by inclusion in this section.

Computing devices such as personal computers, laptop computers, tablet computers, cellular phones, and countless types of Internet-capable devices are increasingly prevalent in numerous aspects of modern life. As such, the demand for data connectivity via the Internet, cellular data networks, and other such networks, is growing. However, there are many areas of the world where data connectivity is still unavailable, or if available, is unreliable and/or costly. Accordingly, additional network infrastructure is desirable.

SUMMARY

An antenna located at ground-level may be used to receive and/or transmit radio signals to balloons in a balloon network. The antenna may be mounted to a building, home, vehicle or other structure, or may be mounted to a post in the ground. The balloons in the balloon network may pass through the emission pattern of the ground-level antenna at varying intervals and at varying altitudes. In some situations, there may be multiple balloons in the emission pattern of the ground-level antenna at any one time. Further, there may be obstructions surrounding the ground-level antenna, such as trees, houses, and other structures. By directing the antenna substantially perpendicular to the ground (i.e., straight up), the antenna may be better positioned to receive radio signals from and/or transmit radio signals to the balloons.

In one aspect, the present disclosure provides a device. The device may include a sealed vessel partially filled with a liquid. The device may also include a floating base that is comprised of a material that is positively buoyant in the liquid. The device may also include an antenna coupled to the floating base. The antenna may be configured to receive and emit radiation. The antenna and the floating base may be positioned within the sealed vessel, and the floating base may be configured to position the antenna such that the antenna emits an emission pattern that is substantially perpendicular to a surface of the liquid.

In another embodiment, the present disclosure provides another device. The device may include a sealed vessel partially filled with a liquid. The device may also include an antenna configured to receive and emit radiation. The device may also include a floating base having a first side and a second side. The first side of the floating base may be coupled to the antenna and the second side of the floating base may be positioned to float on the liquid inside of the sealed vessel. The floating base may be configured to position the a base of the antenna at a non-zero angle with respect to the liquid such that the antenna emits an emission pattern at the non-zero angle with respect to plumb.

In yet another aspect, the present disclosure provides a method. The method may include providing a liquid to a vessel such that the liquid does not fill the vessel. The method may also include coupling a radiator to a reflector such that there is a separation distance between the radiator and the reflector. The radiator may be configured to emit radiation according to a feed signal. The reflector may be configured to direct radiation from the radiator such that the reflected radiation is characterized by an emission pattern. The method may also include coupling a floating base to the reflector. The method may also include positioning the floating base on the liquid inside of the vessel. The method may also include sealing the vessel to prevent the liquid from escaping the vessel.

These as well as other aspects, advantages, and alternatives, will become apparent to those of ordinary skill in the art by reading the following detailed description, with reference where appropriate to the accompanying drawings.

DETAILED DESCRIPTION

Figure 1:
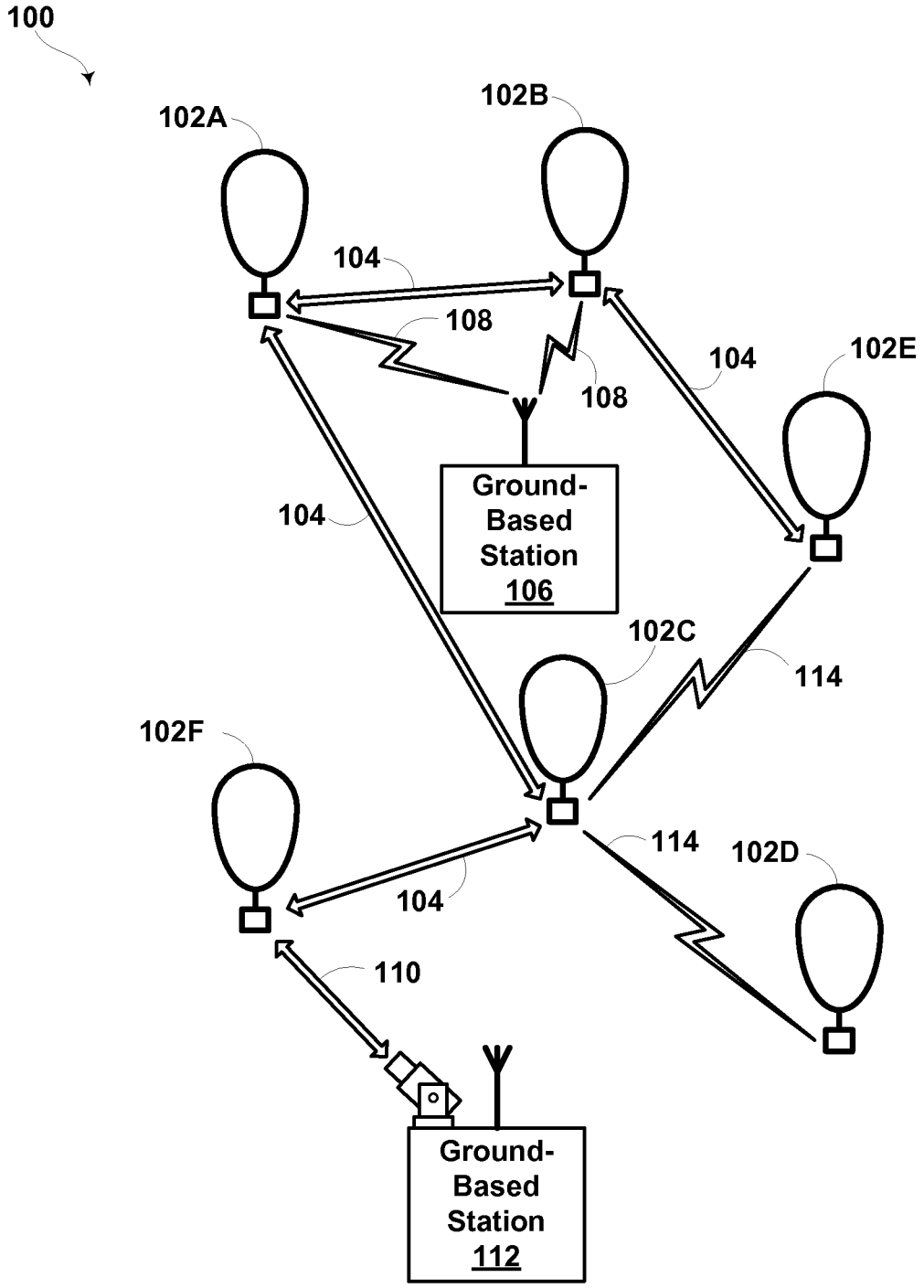
FIG. 1 is a simplified block diagram illustrating a balloon network, according to an example embodiment.

Example methods and systems are described herein. Any example embodiment or feature described herein is not necessarily to be construed as preferred or advantageous over other embodiments or features. The example embodiments described herein are not meant to be limiting. It will be readily understood that certain aspects of the disclosed systems and methods can be arranged and combined in a wide variety of different configurations, all of which are contemplated herein.

Furthermore, the particular arrangements shown in the Figures should not be viewed as limiting. It should be understood that other embodiments may include more or less of each element shown in a given Figure. Further, some of the illustrated elements may be combined or omitted. Yet further, an example embodiment may include elements that are not illustrated in the Figures.

I. OVERVIEW

Example embodiments may relate to a data network formed by balloons, and in particular, to a data network formed by high-altitude balloons deployed in the stratosphere. Various types of balloon systems may be incorporated in an exemplary balloon network. An exemplary embodiment may utilize high-altitude balloons, which typically operate in an altitude range between 18 km and 25 km. The balloons may include an envelope supporting a payload with a power supply, data storage, and one or more transceivers for wirelessly communicating information to antennas located on the ground and/or other members of the balloon network.

An antenna located at ground-level may be used to receive and/or transmit radio signals to balloons in the balloon network. The antenna may be mounted to a building, home, vehicle or other structure, or may be mounted to a post in the ground. Other example locations for the ground-level antenna are possible as well. The balloons, which operate in the stratosphere, may pass through the emission pattern of the ground-level antenna at varying intervals and at varying altitudes. In some situations, there may be multiple balloons in the emission pattern of the ground-level antenna at any one time. Further, there may be obstructions surrounding the ground-level antenna, such as trees, houses, and other structures. By directing the antenna substantially perpendicular to the ground (i.e., straight up), the antenna may be better positioned to receive radio signals from and/or transmit radio signals to the balloons. Therefore, an apparatus to ensure that the antenna is positioned properly may be desirable.

An example device may include a sealed vessel coupled to a support member. The support member may be coupled to a house, building, vehicle or other structure. The sealed vessel may be configured to protect the other components of the device from exposure to the elements. The device may also include an antenna that is configured to receive and emit radiation. In one example, the antenna may include a radiator situated over a reflector. The radiator may be coupled to the reflector by posts. The radiator may include two FR4 panels separated by a few millimeters. In one example, the reflector may be substantially planar, such as a square or rectangle. In another example, the reflector may be a dish, such as a quasi-parabolic dish that may be spherically invariant. The radiator may be configured to emit signals toward the reflector, which results in radiation emitted from the antenna with an emission pattern.

The sealed vessel may be partially filled with a liquid, such as water, mineral oil, or a saline solution as examples. Other potential liquids are possible as well. The antenna may float on the liquid inside of the sealed vessel. In one example, a floating base may be coupled to the antenna to ensure that the antenna floats in the liquid. Optionally, a weight may be coupled to the floating base to increase stability of the antenna. In another example, the antenna may be placed on a material shaped to provide buoyancy. For example, the antenna may be placed on a material having a v-shape, like the hull of a boat. In another example, the antenna may be placed on a material having a parabolic shape. Other examples are possible as well. In operation, the antenna is configured to float on the liquid inside of the sealed vessel. The liquid keeps the antenna substantially perpendicular to the surface of the liquid, even if the sealed vessel is installed at an angle. By directing the antenna substantially perpendicular to the surface of the liquid, the antenna may be better positioned to receive radio signals from and/or transmit radio signals to the balloons.

It should be understood that the above examples are provided for illustrative purposes, and should not be construed as limiting. As such, the method additionally or alternatively includes other steps or includes fewer steps, without departing from the scope of the invention.

II. EXAMPLE BALLOON NETWORKS

Example embodiments help to provide a data network that includes a plurality of balloons; for example, a mesh network formed by high-altitude balloons deployed in the stratosphere. Since winds in the stratosphere may affect the locations of the balloons in a differential manner, each balloon in an example network may be configured to change its horizontal position by adjusting its vertical position (i.e., altitude). For instance, by adjusting its altitude, a balloon may be able find winds that will carry it horizontally (e.g., latitudinally and/or longitudinally) to a desired horizontal location.

Further, in an example balloon network, the balloons may communicate with one another using free-space optical communications. For instance, the balloons may be configured for optical communications using lasers and/or ultra-bright LEDs (which are also referred to as "high-power" or "high-output" LEDs). In addition, the balloons may communicate with ground-based station(s) using radio-frequency (RF) communications.

In some embodiments, a high-altitude-balloon network may be homogenous. That is, the balloons in a high-altitude-balloon network could be substantially similar to each other in one or more ways. More specifically, in a homogenous high-altitude-balloon network, each balloon is configured to communicate with one or more other balloons via free-space optical links. Further, some or all of the balloons in such a network, may additionally be configured to communicate with ground-based and/or satellite-based station(s) using RF and/or optical communications. Thus, in some embodiments, the balloons may be homogenous in so far as each balloon is configured for free-space optical communication with other balloons, but heterogeneous with regard to RF communications with ground-based stations.

In other embodiments, a high-altitude-balloon network may be heterogeneous, and thus may include two or more different types of balloons. For example, some balloons in a heterogeneous network may be configured as super-nodes, while other balloons may be configured as sub-nodes. It is also possible that some balloons in a heterogeneous network may be configured to function as both a super-node and a sub-node. Such balloons may function as either a super-node or a sub-node at a particular time, or, alternatively, act as both simultaneously depending on the context. For instance, an example balloon could aggregate search requests of a first type to transmit to a ground-based station. The example balloon could also send search requests of a second type to another balloon, which could act as a super-node in that context. Further, some balloons, which may be super-nodes in an example embodiment, can be configured to communicate via optical links with ground-based stations and/or satellites.

In an example configuration, the super-node balloons may be configured to communicate with nearby super-node balloons via free-space optical links. However, the sub-node balloons may not be configured for free-space optical communication, and may instead be configured for some other type of communication, such as RF communications. In that case, a super-node may be further configured to communicate with sub-nodes using RF communications. Thus, the sub-nodes may relay communications between the super-nodes and one or more ground-based stations using RF communications. In this way, the super-nodes may collectively function as backhaul for the balloon network, while the sub-nodes function to relay communications from the super-nodes to ground-based stations.

FIG. 1 is a simplified block diagram illustrating a balloon network 100, according to an example embodiment. As shown, balloon network 100 includes balloons 102A to 102F, which are configured to communicate with one another via free-space optical links 104. Balloons 102A to 102F could additionally or alternatively be configured to communicate with one another via RF links 114. Balloons 102A to 102F may collectively function as a mesh network for packet-data communications. Further, at least some of balloons 102A and 102B may be configured for RF communications with ground-based stations 106 and 112 via respective RF links 108. Further, some balloons, such as balloon 102F, could be configured to communicate via optical link 110 with ground-based station 112.

In an example embodiment, balloons 102A to 102F are high-altitude balloons, which are deployed in the stratosphere. At moderate latitudes, the stratosphere includes altitudes between approximately 10 kilometers (km) and 50 km altitude above the surface. At the poles, the stratosphere starts at an altitude of approximately 8 km. In an example embodiment, high-altitude balloons may be generally configured to operate in an altitude range within the stratosphere that has relatively low wind speed (e.g., between 5 and 20 miles per hour (mph)).

More specifically, in a high-altitude-balloon network, balloons 102A to 102F may generally be configured to operate at altitudes between 18 km and 25 km (although other altitudes are possible). This altitude range may be advantageous for several reasons. In particular, this layer of the stratosphere generally has relatively low wind speeds (e.g., winds between 5 and 20 mph) and relatively little turbulence. Further, while the winds between 18 km and 25 km may vary with latitude and by season, the variations can be modeled in a reasonably accurate manner. Additionally, altitudes above 18 km are typically above the maximum flight level designated for commercial air traffic. Therefore, interference with commercial flights is not a concern when balloons are deployed between 18 km and 25 km.

To transmit data to another balloon, a given balloon 102A to 102F may be configured to transmit an optical signal via an optical link 104. In an example embodiment, a given balloon 102A to 102F may use one or more high-power light-emitting diodes (LEDs) to transmit an optical signal. Alternatively, some or all of balloons 102A to 102F may include laser systems for free-space optical communications over optical links 104. Other types of free-space optical communication are possible. Further, in order to receive an optical signal from another balloon via an optical link 104, a given balloon 102A to 102F may include one or more optical receivers. Additional details of example balloons are discussed in greater detail below, with reference to FIG. 3.

In a further aspect, balloons 102A to 102F may utilize one or more of various different RF air-interface protocols for communication with ground-based stations 106 and 112 via respective RF links 108. For instance, some or all of balloons 102A to 102F may be configured to communicate with ground-based stations 106 and 112 using protocols described in IEEE 802.11 (including any of the IEEE 802.11 revisions), various cellular protocols such as GSM, CDMA, UMTS, EV-DO, WiMAX, and/or LTE, and/or one or more propriety protocols developed for balloon-ground RF communication, among other possibilities.

In a further aspect, there may be scenarios where RF links 108 do not provide a desired link capacity for balloon-to-ground communications. For instance, increased capacity may be desirable to provide backhaul links from a ground-based gateway, and in other scenarios as well. Accordingly, an example network may also include downlink balloons, which could provide a high-capacity air-ground link.

For example, in balloon network 100, balloon 102F is configured as a downlink balloon. Like other balloons in an example network, a downlink balloon 102F may be operable for optical communication with other balloons via optical links 104. However, a downlink balloon 102F may also be configured for free-space optical communication with a ground-based station 112 via an optical link 110. Optical link 110 may therefore serve as a high-capacity link (as compared to an RF link 108) between the balloon network 100 and the ground-based station 112.

Note that in some implementations, a downlink balloon 102F may additionally be operable for RF communication with ground-based stations 106. In other cases, a downlink balloon 102F may only use an optical link for balloon-to-ground communications. Further, while the arrangement shown in FIG. 1 includes just one downlink balloon 102F, an example balloon network can also include multiple downlink balloons. On the other hand, a balloon network can also be implemented without any downlink balloons.

In other implementations, a downlink balloon may be equipped with a specialized, high-bandwidth RF communication system for balloon-to-ground communications, instead of, or in addition to, a free-space optical communication system. The high-bandwidth RF communication system may take the form of an ultra-wideband system, which may provide an RF link with substantially the same capacity as one of the optical links 104. Other forms are also possible.

Ground-based stations, such as ground-based stations 106 and/or 112, may take various forms. Generally, a ground-based station may include components such as transceivers, transmitters, and/or receivers for communication via RF links and/or optical links with a balloon network. Further, a ground-based station may use various air-interface protocols in order to communicate with a balloon 102A to 102F over an RF link 108. As such, ground-based stations 106 and 112 may be configured as an access point via which various devices can connect to balloon network 100. Ground-based stations 106 and 112 may have other configurations and/or serve other purposes without departing from the scope of the invention.

In a further aspect, some or all of balloons 102A to 102F could be configured to establish a communication link with space-based satellites in addition to, or as an alternative to, a ground-based communication link. In some embodiments, a balloon may communicate with a satellite via an optical link. However, other types of satellite communications are possible.

Further, some ground-based stations, such as ground-based stations 106 and 112, may be configured as gateways between balloon network 100 and one or more other networks. Such ground-based stations 106 and 112 may thus serve as an interface between the balloon network and the Internet, a cellular service provider's network, and/or other types of networks. Variations on this configuration and other configurations of ground-based stations 106 and 112 are also possible.

A. Station-Keeping Functionality

In an example embodiment, a balloon network 100 may implement station-keeping functions to help provide a desired network topology. For example, station-keeping may involve each balloon 102A to 102F maintaining and/or moving into a certain position relative to one or more other balloons in the network (and possibly in a certain position relative to the ground). As part of this process, each balloon 102A to 102F may implement station-keeping functions to determine its desired positioning within the desired topology, and if necessary, to determine how to move to the desired position.

The desired topology may vary depending upon the particular implementation. In some cases, balloons may implement station-keeping to provide a substantially uniform topology. In such cases, a given balloon 102A to 102F may implement station-keeping functions to position itself at substantially the same distance (or within a certain range of distances) from adjacent balloons in the balloon network 100.

In other cases, a balloon network 100 may have a non-uniform topology. For instance, example embodiments may involve topologies where balloons are distributed more or less densely in certain areas, for various reasons. As an example, to help meet the higher bandwidth demands that are typical in urban areas, balloons may be clustered more densely over urban areas. For similar reasons, the distribution of balloons may be denser over land than over large bodies of water. Many other examples of non-uniform topologies are possible.

In a further aspect, the topology of an example balloon network may be adaptable. In particular, station-keeping functionality of example balloons may allow the balloons to adjust their respective positioning in accordance with a change in the desired topology of the network. For example, one or more balloons could move to new positions to increase or decrease the density of balloons in a given area.

Further, in some embodiments, some or all balloons may be continually moving while at the same time maintaining desired coverage over the ground (e.g., as balloons move out of an area, other balloons move in to take their place). In such an embodiment, a station-keeping process may in fact take the form of fleet-planning process that plans and coordinates the movement of the balloons. Other examples of station-keeping are also possible.

B. Control of Balloons in a Balloon Network

Figure 2:
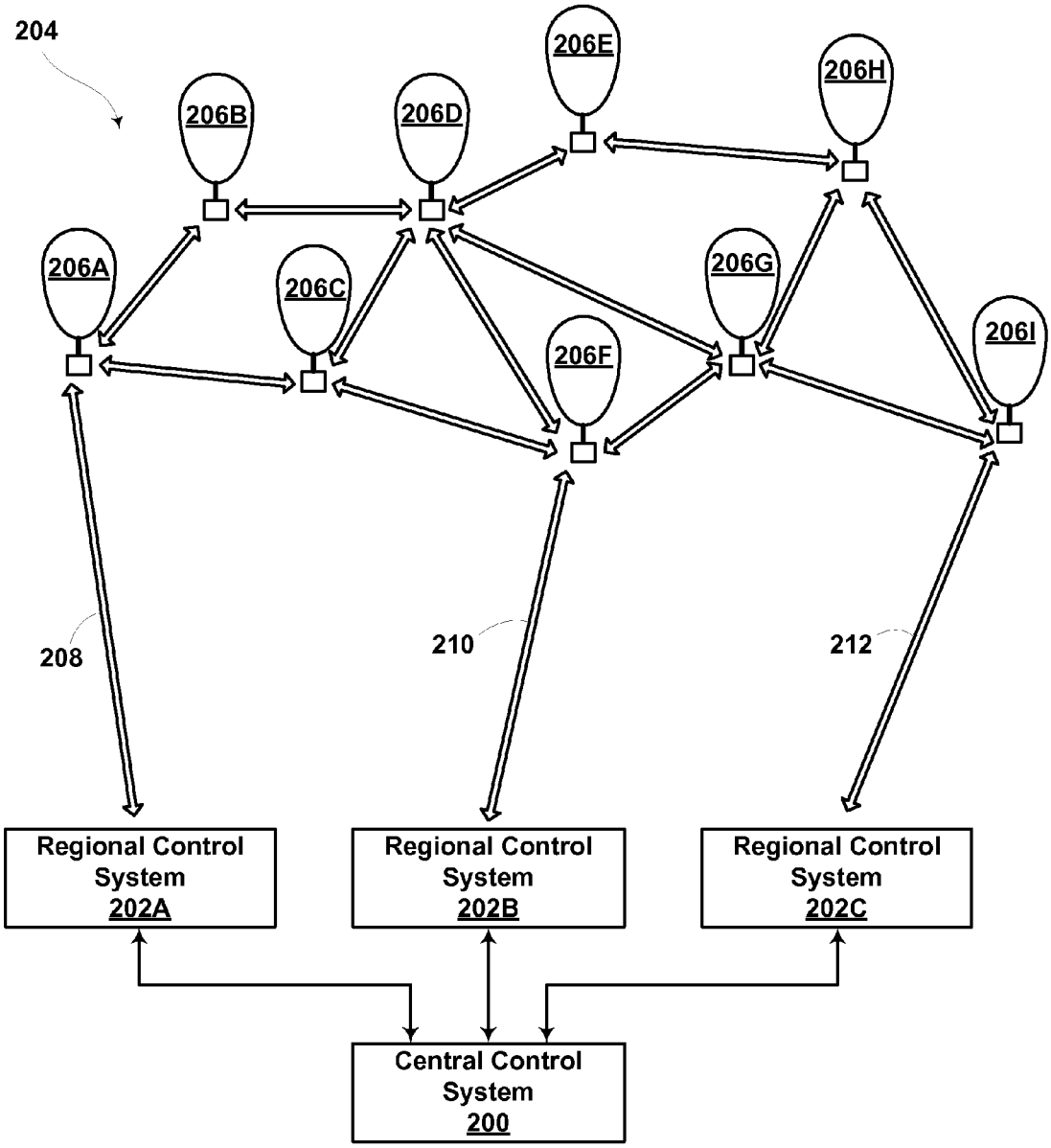
FIG. 2 is a simplified block diagram illustrating a balloon-network control system, according to an example embodiment.

In some embodiments, mesh networking and/or station-keeping functions may be centralized. For example, FIG. 2 is a block diagram illustrating a balloon-network control system, according to an example embodiment. In particular, FIG. 2 shows a distributed control system, which includes a central control system 200 and a number of regional control-systems 202A to 202B. Such a control system may be configured to coordinate certain functionality for balloon network 204, and as such, may be configured to control and/or coordinate certain functions for balloons 206A to 206I.

In the illustrated embodiment, central control system 200 may be configured to communicate with balloons 206A to 206I via a number of regional control systems 202A to 202C. These regional control systems 202A to 202C may be configured to receive communications and/or aggregate data from balloons in the respective geographic areas that they cover, and to relay the communications and/or data to central control system 200. Further, regional control systems 202A to 202C may be configured to route communications from central control system 200 to the balloons in their respective geographic areas. For instance, as shown in FIG. 2, regional control system 202A may relay communications and/or data between balloons 206A to 206C and central control system 200, regional control system 202B may relay communications and/or data between balloons 206D to 206F and central control system 200, and regional control system 202C may relay communications and/or data between balloons 206G to 206I and central control system 200.

In order to facilitate communications between the central control system 200 and balloons 206A to 206I, certain balloons may be configured as downlink balloons, which are operable to communicate with regional control systems 202A to 202C. Accordingly, each regional control system 202A to 202C may be configured to communicate with the downlink balloon or balloons in the respective geographic area it covers. For example, in the illustrated embodiment, balloons 206A, 206F, and 206I are configured as downlink balloons. As such, regional control systems 202A to 202C may respectively communicate with balloons 206A, 206F, and 206I via optical links 206, 208, and 210, respectively.

In the illustrated configuration, only some of balloons 206A to 206I are configured as downlink balloons. The balloons 206A, 206F, and 206I that are configured as downlink balloons may relay communications from central control system 200 to other balloons in the balloon network, such as balloons 206B to 206E, 206G, and 206H. However, it should be understood that in some implementations, it is possible that all balloons may function as downlink balloons. Further, while FIG. 2 shows multiple balloons configured as downlink balloons, it is also possible for a balloon network to include only one downlink balloon, or possibly even no downlink balloons.

Note that a regional control system 202A to 202C may in fact just be a particular type of ground-based station that is configured to communicate with downlink balloons (e.g., such as ground-based station 112 of FIG. 1). Thus, while not shown in FIG. 2, a control system may be implemented in conjunction with other types of ground-based stations (e.g., access points, gateways, etc.).

In a centralized control arrangement, such as that shown in FIG. 2, the central control system 200 (and possibly regional control systems 202A to 202C as well) may coordinate certain mesh-networking functions for balloon network 204. For example, balloons 206A to 206I may send the central control system 200 certain state information, which the central control system 200 may utilize to determine the state of balloon network 204. The state information from a given balloon may include location data, optical-link information (e.g., the identity of other balloons with which the balloon has established an optical link, the bandwidth of the link, wavelength usage and/or availability on a link, etc.), wind data collected by the balloon, and/or other types of information. Accordingly, the central control system 200 may aggregate state information from some or all of the balloons 206A to 206I in order to determine an overall state of the network.

The overall state of the network may then be used to coordinate and/or facilitate certain mesh-networking functions such as determining lightpaths for connections. For example, the central control system 200 may determine a current topology based on the aggregate state information from some or all of the balloons 206A to 206I. The topology may provide a picture of the current optical links that are available in balloon network and/or the wavelength availability on the links. This topology may then be sent to some or all of the balloons so that a routing technique may be employed to select appropriate lightpaths (and possibly backup lightpaths) for communications through the balloon network 204.

FIG. 2 shows a distributed arrangement that provides centralized control, with regional control systems 202A to 202C coordinating communications between a central control system 200 and a balloon network 204. Such an arrangement may be useful to provide centralized control for a balloon network that covers a large geographic area. In some embodiments, a distributed arrangement may even support a global balloon network that provides coverage everywhere on earth. Of course, a distributed-control arrangement may be useful in other scenarios as well.

Further, it should be understood that other control-system arrangements are also possible. For instance, some implementations may involve a centralized control system with additional layers (e.g., sub-region systems within the regional control systems, and so on). Alternatively, control functions may be provided by a single, centralized, control system, which communicates directly with one or more downlink balloons.

In some embodiments, control and coordination of a balloon network may be shared by a ground-based control system and a balloon network to varying degrees, depending upon the implementation. In fact, in some embodiments, there may be no ground-based control systems. In such an embodiment, all network control and coordination functions may be implemented by the balloon network itself. For example, certain balloons may be configured to provide the same or similar functions as central control system 200 and/or regional control systems 202A to 202C. Other examples are also possible.

Furthermore, control and/or coordination of a balloon network may be de-centralized. For example, each balloon may relay state information to, and receive state information from, some or all nearby balloons. Further, each balloon may relay state information that it receives from a nearby balloon to some or all nearby balloons. When all balloons do so, each balloon may be able to individually determine the state of the network. Alternatively, certain balloons may be designated to aggregate state information for a given portion of the network. These balloons may then coordinate with one another to determine the overall state of the network.

Further, in some aspects, control of a balloon network may be partially or entirely localized, such that it is not dependent on the overall state of the network. For example, individual balloons may implement station-keeping functions that only consider nearby balloons. In particular, each balloon may implement an energy function that takes into account its own state and the states of nearby balloons. The energy function may be used to maintain and/or move to a desired position with respect to the nearby balloons, without necessarily considering the desired topology of the network as a whole. However, when each balloon implements such an energy function for station-keeping, the balloon network as a whole may maintain and/or move towards the desired topology.

Further, control systems such as those described above may determine when and/or where individual balloons should be taken down. Additionally, the control systems may navigate the balloons to locations where they are to be taken down. The control systems may also cause the balloons to be taken down, and may control their descent and/or otherwise facilitate their descent.

III. EXEMPLARY BALLOON CONFIGURATION

Figure 3:
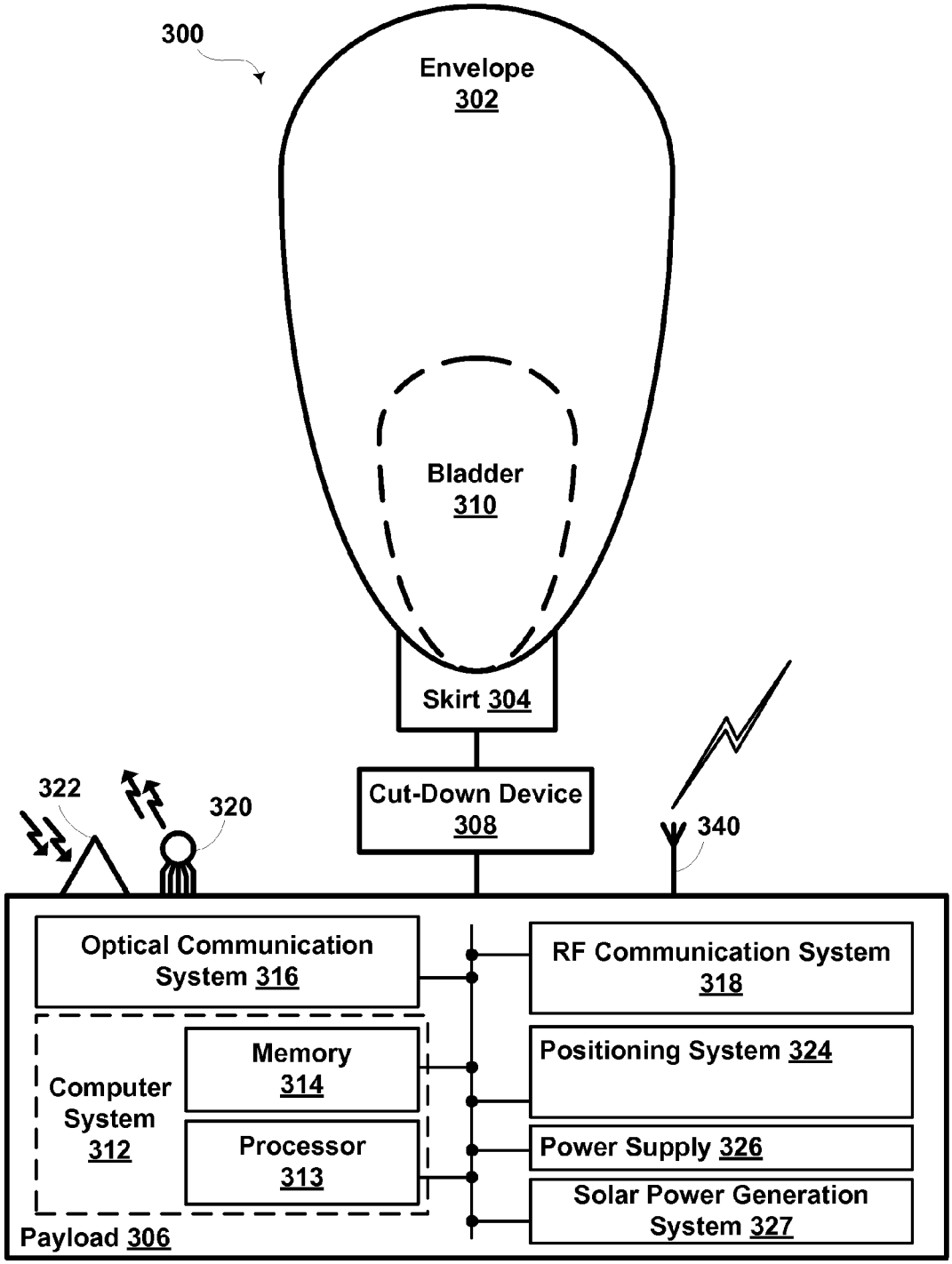
FIG. 3 is a simplified block diagram illustrating a high-altitude balloon, according to an example embodiment.

Various types of balloon systems may be incorporated in an example balloon network. As noted above, an example embodiment may utilize high-altitude balloons, which could typically operate in an altitude range between 18 km and 25 km. FIG. 3 shows a high-altitude balloon 300, according to an example embodiment. As shown, the balloon 300 includes an envelope 302, a skirt 304, a payload 306, and a cut-down device 308, which is attached between the balloon 302 and payload 306.

The envelope 302 and skirt 304 may take various forms, which may be currently well-known or yet to be developed. For instance, the envelope 302 and/or skirt 304 may be made of materials including metalized Mylar or BoPet. Additionally or alternatively, some or all of the envelope 302 and/or skirt 304 may be constructed from a highly-flexible latex material or a rubber material such as chloroprene. Other materials are also possible. Further, the shape and size of the envelope 302 and skirt 304 may vary depending upon the particular implementation. Additionally, the envelope 302 may be filled with various different types of gases, such as helium and/or hydrogen. Other types of gases are possible as well.

The payload 306 of balloon 300 may include a computer system 312, which may include a processor 313 and on-board data storage, such as memory 314. The memory 314 may take the form of or include a non-transitory computer-readable medium. The non-transitory computer-readable medium may have instructions stored thereon, which can be accessed and executed by the processor 313 in order to carry out the balloon functions described herein. Thus, processor 313, in conjunction with instructions stored in memory 314, and/or other components, may function as a controller of balloon 300.

The payload 306 of balloon 300 may also include various other types of equipment and systems to provide a number of different functions. For example, payload 306 may include an optical communication system 316, which may transmit optical signals via an ultra-bright LED system 320, and which may receive optical signals via an optical-communication receiver 322 (e.g., a photodiode receiver system). Further, payload 306 may include an RF communication system 318, which may transmit and/or receive RF communications via an antenna system 340.

The payload 306 may also include a power supply 326 to supply power to the various components of balloon 300. The power supply 326 could include a rechargeable battery. In other embodiments, the power supply 326 may additionally or alternatively represent other means known in the art for producing power. In addition, the balloon 300 may include a solar power generation system 327. The solar power generation system 327 may include solar panels and could be used to generate power that charges and/or is distributed by the power supply 326.

The payload 306 may additionally include a positioning system 324. The positioning system 324 could include, for example, a global positioning system (GPS), an inertial navigation system, and/or a star-tracking system. The positioning system 324 may additionally or alternatively include various motion sensors (e.g., accelerometers, magnetometers, gyroscopes, and/or compasses).

The positioning system 324 may additionally or alternatively include one or more video and/or still cameras, and/or various sensors for capturing environmental data.

Some or all of the components and systems within payload 306 may be implemented in a radiosonde or other probe, which may be operable to measure, e.g., pressure, altitude, geographical position (latitude and longitude), temperature, relative humidity, and/or wind speed and/or wind direction, among other information.

As noted, balloon 300 includes an ultra-bright LED system 320 for free-space optical communication with other balloons. As such, optical communication system 316 may be configured to transmit a free-space optical signal by modulating the ultra-bright LED system 320. The optical communication system 316 may be implemented with mechanical systems and/or with hardware, firmware, and/or software. Generally, the manner in which an optical communication system is implemented may vary, depending upon the particular application. The optical communication system 316 and other associated components are described in further detail below.

In a further aspect, balloon 300 may be configured for altitude control. For instance, balloon 300 may include a variable buoyancy system, which is configured to change the altitude of the balloon 300 by adjusting the volume and/or density of the gas in the balloon 300. A variable buoyancy system may take various forms, and may generally be any system that can change the volume and/or density of gas in the envelope 302.

In an example embodiment, a variable buoyancy system may include a bladder 310 that is located inside of envelope 302. The bladder 310 could be an elastic chamber configured to hold liquid and/or gas. Alternatively, the bladder 310 need not be inside the envelope 302. For instance, the bladder 310 could be a rigid bladder that could be pressurized well beyond neutral pressure. The buoyancy of the balloon 300 may therefore be adjusted by changing the density and/or volume of the gas in bladder 310. To change the density in bladder 310, balloon 300 may be configured with systems and/or mechanisms for heating and/or cooling the gas in bladder 310. Further, to change the volume, balloon 300 may include pumps or other features for adding gas to and/or removing gas from bladder 310. Additionally or alternatively, to change the volume of bladder 310, balloon 300 may include release valves or other features that are controllable to allow gas to escape from bladder 310. Multiple bladders 310 could be implemented within the scope of this disclosure. For instance, multiple bladders could be used to improve balloon stability.

In an example embodiment, the envelope 302 could be filled with helium, hydrogen or other lighter-than-air material. The envelope 302 could thus have an associated upward buoyancy force. In such an embodiment, air in the bladder 310 could be considered a ballast tank that may have an associated downward ballast force. In another example embodiment, the amount of air in the bladder 310 could be changed by pumping air (e.g., with an air compressor) into and out of the bladder 310. By adjusting the amount of air in the bladder 310, the ballast force may be controlled. In some embodiments, the ballast force may be used, in part, to counteract the buoyancy force and/or to provide altitude stability.

In other embodiments, the envelope 302 could be substantially rigid and include an enclosed volume. Air could be evacuated from envelope 302 while the enclosed volume is substantially maintained. In other words, at least a partial vacuum could be created and maintained within the enclosed volume. Thus, the envelope 302 and the enclosed volume could become lighter-than-air and provide a buoyancy force. In yet other embodiments, air or another material could be controllably introduced into the partial vacuum of the enclosed volume in an effort to adjust the overall buoyancy force and/or to provide altitude control.

In another embodiment, a portion of the envelope 302 could be a first color (e.g., black) and/or a first material from the rest of envelope 302, which may have a second color (e.g., white) and/or a second material. For instance, the first color and/or first material could be configured to absorb a relatively larger amount of solar energy than the second color and/or second material. Thus, rotating the balloon such that the first material is facing the sun may act to heat the envelope 302 as well as the gas inside the envelope 302. In this way, the buoyancy force of the envelope 302 may increase. By rotating the balloon such that the second material is facing the sun, the temperature of gas inside the envelope 302 may decrease. Accordingly, the buoyancy force may decrease. In this manner, the buoyancy force of the balloon could be adjusted by changing the temperature/volume of gas inside the envelope 302 using solar energy. In such embodiments, it is possible that a bladder 310 may not be a necessary element of balloon 300. Thus, in various contemplated embodiments, altitude control of balloon 300 could be achieved, at least in part, by adjusting the rotation of the balloon with respect to the sun.

Further, a balloon 306 may include a navigation system (not shown). The navigation system may implement station-keeping functions to maintain position within and/or move to a position in accordance with a desired topology. In particular, the navigation system may use altitudinal wind data to determine altitudinal adjustments that result in the wind carrying the balloon in a desired direction and/or to a desired location. The altitude-control system may then make adjustments to the density of the balloon chamber in order to effectuate the determined altitudinal adjustments and cause the balloon to move laterally to the desired direction and/or to the desired location. Alternatively, the altitudinal adjustments may be computed by a ground-based or satellite-based control system and communicated to the high-altitude balloon. In other embodiments, specific balloons in a heterogeneous balloon network may be configured to compute altitudinal adjustments for other balloons and transmit the adjustment commands to those other balloons.

As shown, the balloon 300 also includes a cut-down device 308. The cut-down device 308 may be activated to separate the payload 306 from the rest of balloon 300. The cut-down device 308 could include at least a connector, such as a balloon cord, connecting the payload 306 to the envelope 302 and a means for severing the connector (e.g., a shearing mechanism or an explosive bolt). In an example embodiment, the balloon cord, which may be nylon, is wrapped with a nichrome wire. A current could be passed through the nichrome wire to heat it and melt the cord, cutting the payload 306 away from the envelope 302.

The cut-down functionality may be utilized anytime the payload needs to be accessed on the ground, such as when it is time to remove balloon 300 from a balloon network, when maintenance is due on systems within payload 306, and/or when power supply 326 needs to be recharged or replaced.

In an alternative arrangement, a balloon may not include a cut-down device. In such an arrangement, the navigation system may be operable to navigate the balloon to a landing location, in the event the balloon needs to be removed from the network and/or accessed on the ground. Further, it is possible that a balloon may be self-sustaining, such that it does not need to be accessed on the ground. In yet other embodiments, in-flight balloons may be serviced by specific service balloons or another type of service aerostat or service aircraft. In yet another embodiment, the balloon may include a parachute system configured to enable the balloon 300 and payload 306 to descend safely to the ground.

IV. EXAMPLE ANTENNA SYSTEMS

As discussed above, an antenna located at ground-level may be used to receive and/or transmit radio signals to balloons in the balloon network. The antenna may be mounted to a building, home, vehicle or other structure, or may be mounted to a post in the ground. Other example locations for the ground-level antenna are possible as well. The balloons, which operate in the stratosphere, may pass through the emission pattern of the ground-level antenna at varying intervals and at varying altitudes. In some situations, there may be multiple balloons in the emission pattern of the ground-level antenna at any one time. Further, there may be obstructions surrounding the ground-level antenna, such as trees, houses, and other structures. By directing the antenna substantially perpendicular to the ground (i.e., straight up), the antenna may be better positioned to receive radio signals from and/or transmit radio signals to the balloons. Therefore, an apparatus to ensure that the antenna is positioned properly may be desirable.

Figure 4A:
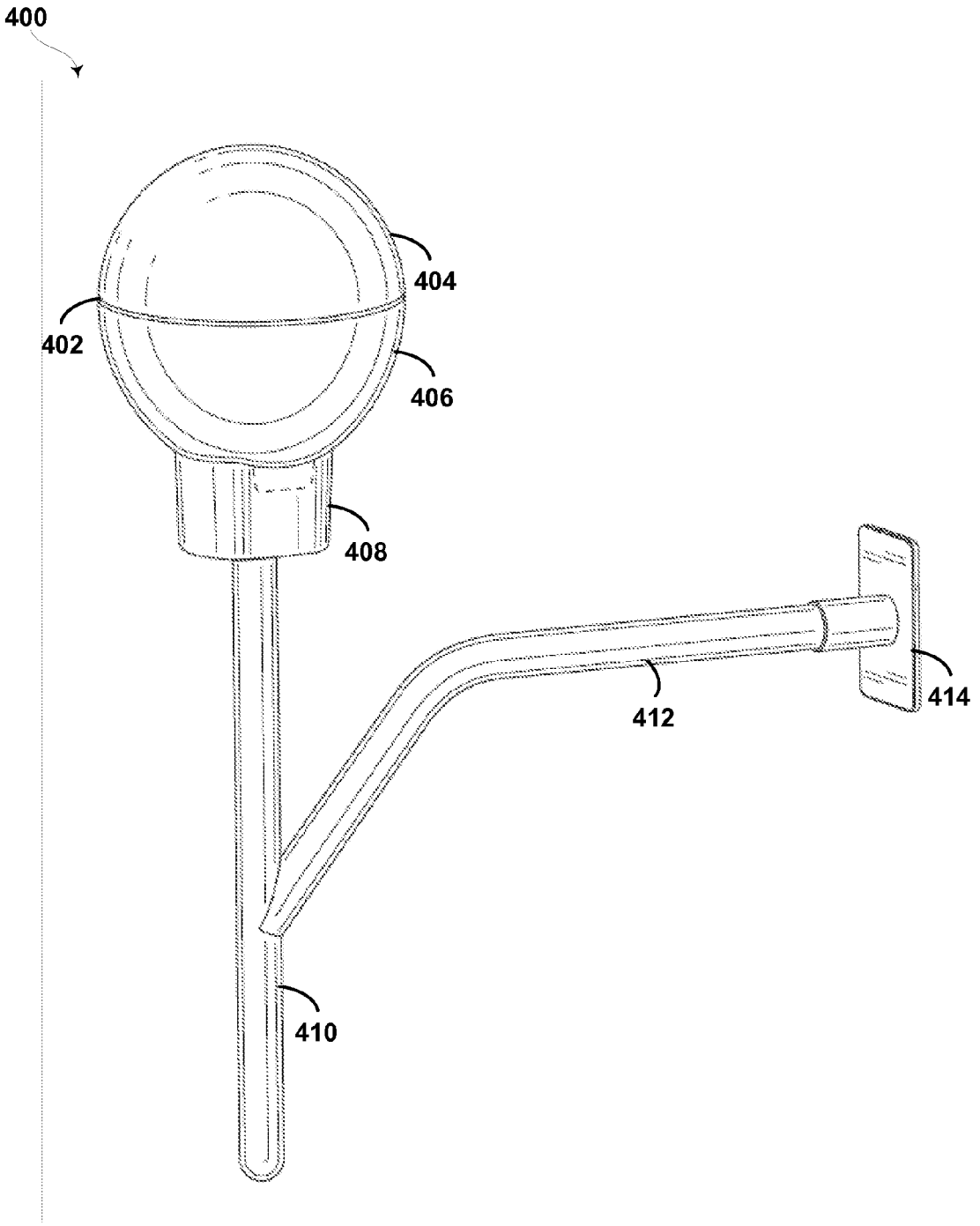
FIG. 4A is an embodiment of an example device for connectivity to a balloon network in a perspective view, according to an example embodiment.

FIG. 4A illustrates an embodiment of an example device 400 for connectivity to a balloon network in a perspective view. The device 400 may include a sealed vessel 402 having an upper portion 404 and a lower portion 406. The upper portion 404 may be coupled to the lower portion 406 via a coupling mechanism, such as a hinge and clasp or some other mechanism. In another example, the edge of the upper portion 404 and the edge of the lower portion 406 may be threaded so that the two portions of the sealed vessel 402 may be coupled by screwing the upper portion 404 into the lower portion 406. In another example, the upper portion 404 and the lower portion 406 may be press fit together. In yet another example, an adhesive may be used to couple the upper portion 404 to the lower portion 406. Before coupling the upper portion 404 to the lower portion 406 to create the sealed vessel 402, a liquid may be added to the lower portion 406, as discussed in more detail below. In yet another example, the sealed vessel 402 may be formed from a single piece of material. Other embodiments are possible as well.

The device 400 may also include an electronics compartment 408. The electronics compartment 408 may house various electronic components of the device 400. For example, the electronic compartment 408 may include a computer system, including memory and a processor. The electronics compartment 408 may also include a power supply, and a positioning system, as examples. Further, the electronics compartment 408 may include a transmitter configured to provide input signals to an antenna positioned inside of the sealed vessel 402. In another example, the electronics compartment 408 may include a receiver configured to receive information based on harvested radio energy radiating through free space to excite the antenna. Other electronic components are possible as well.

Figure 4B:
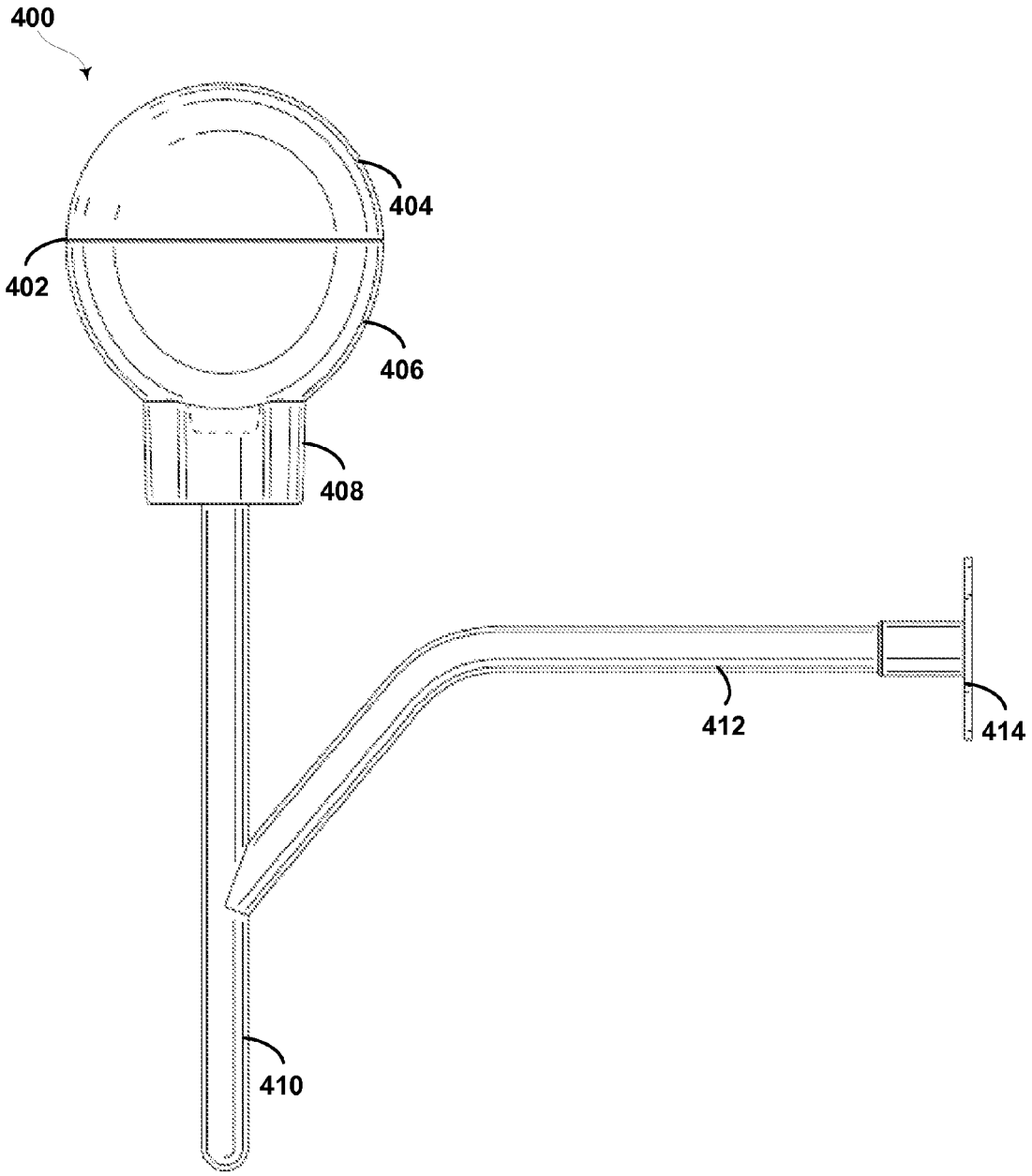
FIG. 4B is an embodiment of an example device for connectivity to a balloon network in a right side view, according to an example embodiment.
Figure 4C:
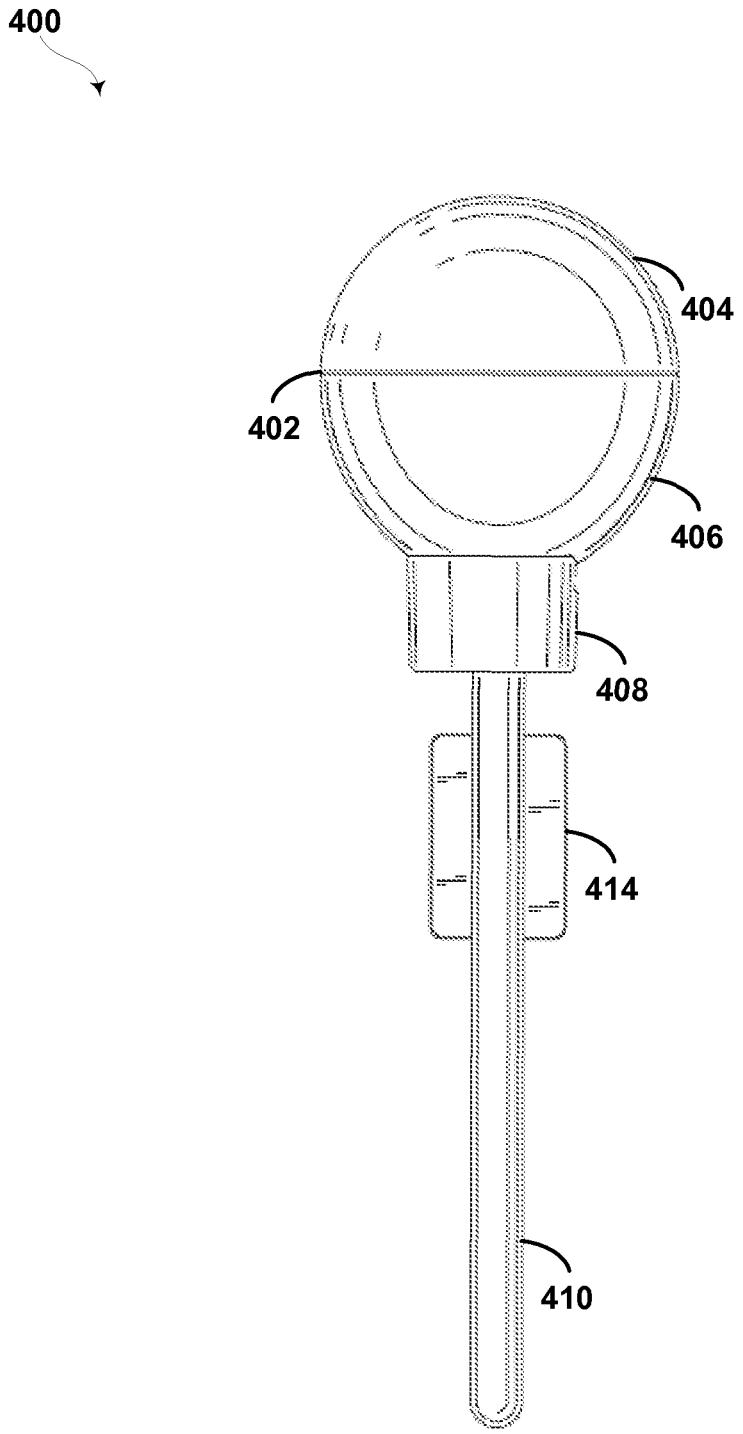
FIG. 4C is an embodiment of an example device for connectivity to a balloon network in a front view, according to an example embodiment.

The device 400 may be supported by a support member 410. In one example, support member 410 is a post that is installed in the ground. In another example, support member 410 is connected to a horizontal support member 412. The horizontal support member 412 may be coupled to a mounting member 414, which in turn may be connected to a building, or some other structure. In one example, the mounting member 414 may have one or more holes through which screws or nails can fit to secure the device 400 to an exterior wall of a building, vehicle or other structure. FIG. 4B illustrates example device 400 in a right side view, and FIG. 4C further illustrates example device 400 in a front view.

Figure 4E:
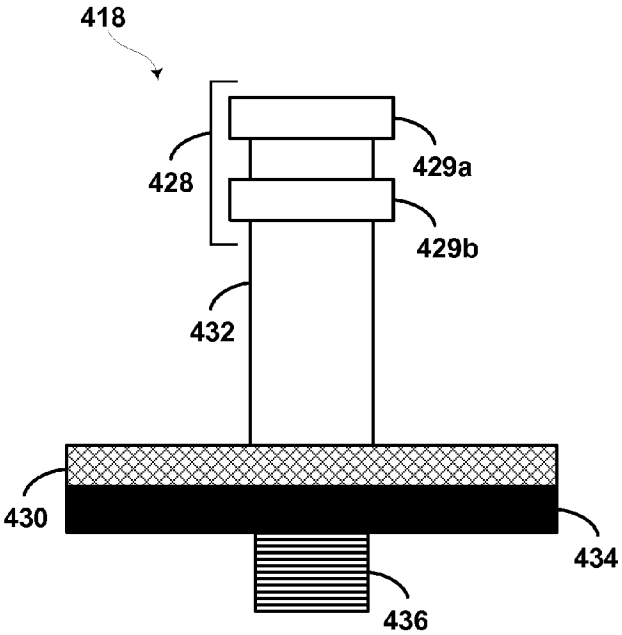
FIG. 4E illustrates an example antenna, according to an example embodiment.
Figure 4D:
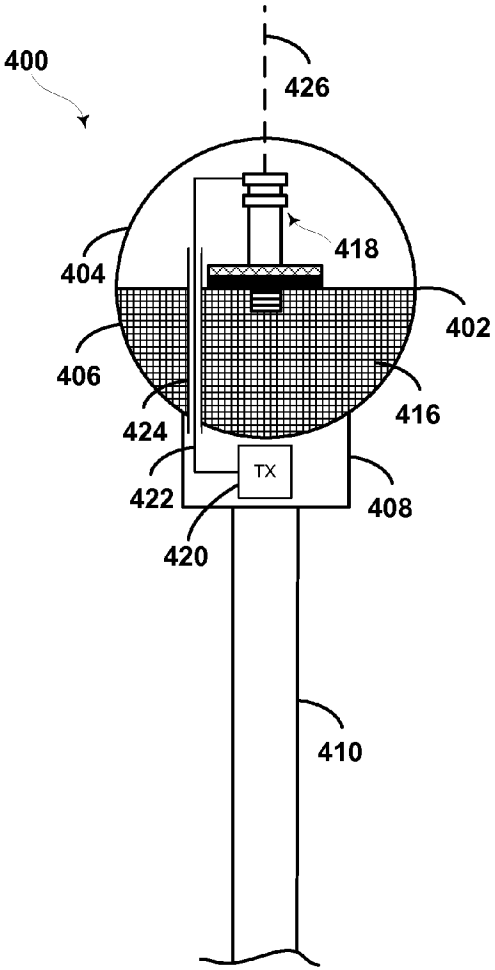
FIG. 4D illustrates a cross-sectional view of an example device for connectivity to a balloon network, according to an example embodiment.

FIG. 4D illustrates a cross-sectional view of example device 400. The sealed vessel 402 may be partially filled with a liquid 416. The liquid may be water, mineral oil, or a saline solution as examples. Other potential liquids are possible as well. Further, an antenna 418 may be positioned inside of the sealed vessel 402 and may be configured to float on the liquid 416. As shown in FIG. 4D, a transmitter 420 may be connected to the antenna 418 via a transmission line 422. The transmission line 422 may pass through a conduit 424 that is configured to insulate the transmission line 422 from the liquid 416. The transmitter 420 can thus provide input signals to the antenna 418 to cause the antenna 418 to emit corresponding radiation, which may be characterized by an emission pattern 426. In some embodiments, the antenna 418 may be used to receive incoming radiation. In such an embodiment, the transmitter 420 may be replaced by a receiver configured to receive information based on harvested radio energy radiating through free space to excite the antenna 418.

FIG. 4E illustrates an example antenna 418, according to an example embodiment. The antenna 418 may include a radiator 428 configured to emit radiation according to input signals (e.g., from transmitter 420). The radiator 428 can be any type of directional or non-directional radiating element suitable for emitting signals according to inputs, such as a horn feed antenna, a bi-pole antenna, etc. In a specific example, the radiator 428 may include two FR4 panels 429*a*, 429*b*. The antenna 418 may also include a reflector 430 coupled to the radiator 428 via posts 432. The reflector 430 can be a solid or non-solid (e.g., mesh), and may be spherically invariant dish (e.g., the reflective surface of the dish may be equidistant from a common point, or spherical center). In one example, the reflector may include copper or aluminium. Further, the reflector 430 may be a cylindrically symmetric dish with a concave curvature defined by a parabolic curvature. In some examples, moreover, the reflector 430 may be a single flat, planar reflective surface, or may be formed of multiple flat panels which may be co-planar or may be combined to create a general concave or convex curvature so as to direct the radiation emitted from the radiator 428 according to a desired emission pattern 426.

The radiator 428 and reflector 430 can be similar to a patch antenna in some examples. In some examples, the radiator 428 may be a planar conductive component with an approximate area of 50 millimeters squared. The reflector 430 may be a planar conductive component plane parallel to the radiator 428 and with an approximate area of 300 millimeters squared. The radiator 428 and reflector 430 may be separated by a separation distance of approximately 75 millimeters. By varying the separation distance between the radiator 428 and the reflector 430, the emission pattern of the antenna 418 may be adjusted. In one example, a linkage (not shown) may be configured to adjust the separation distance between the radiator 428 and the reflector 430.

The antenna 418 may also include a floating base 434. The floating base 434 may be formed from Styrofoam, or some other material that is positively buoyant in the liquid 416. The floating base 434 enables the antenna 418 to float on the liquid 416 inside of the sealed vessel 402. In one example, the floating base 434 covers the entire base of the reflector 430. In another example, the floating base 434 includes buoyant material coupled to the perimeter of the reflector 430. In yet another example, the floating base may be parabolic in shape or v-shaped to enable the antenna 418 to float on the liquid 416. Further, a weight 436 may be coupled to the floating base 434 to stabilize the antenna 418 in the liquid 416. The weight 436 may include a non-buoyant material, such as lead, that may prevent the antenna 418 from tipping over in the sealed vessel 402. Other materials are possible as well.

Figure 4F:
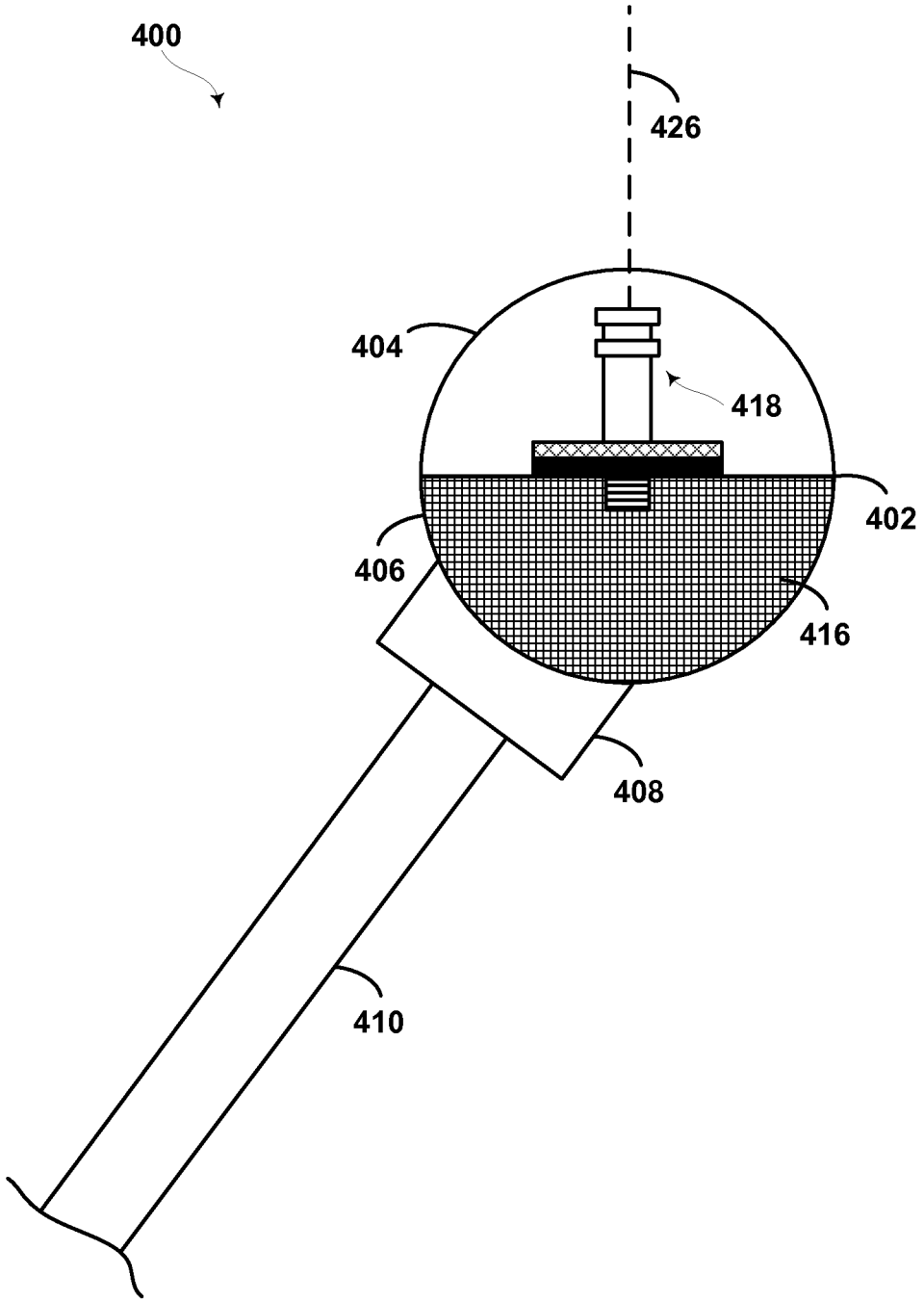
FIG. 4F illustrates a cross-sectional view of an example device for connectivity to a balloon network, according to an example embodiment.

FIG. 4F illustrates a cross-sectional view of example device 400 where the support member 410 is not perpendicular to the ground. In one example, such a scenario may occur if the device 400 is not installed properly and the support member 410 is not perpendicular to the ground because of user error. It is desirable that non-trained installers (e.g., your average home owner) can easily install the device 400. The self-levelling aspect may be helpful in this regard as it helps the average person install such an antenna (e.g., without requiring special alignment). Further, the device 400 also allows for flexibility in installation location, which is desirable. In particular, the angle of the mounting surface may vary, providing flexibility. In another example, the device 400 is installed on a boat, and the rocking of the boat may cause the support member 410 to move from a perpendicular position. Other potential scenarios are possible as well.

As shown in FIG. 4F, even if the support member 410 is not perpendicular to the ground, the liquid 416 inside of the sealed vessel 402 ensures that the base of the antenna 418 is level and that the antenna 418 emits an emission pattern 426 that is perpendicular to the surface of the liquid 416. As discussed above, such an antenna 418 may be used to communicate with a balloon network. The balloons may pass through the emission pattern of the antenna 418 at varying intervals and at varying altitudes. In some situations, there may be multiple balloons in the emission pattern of the antenna 418 at any one time. Further, there may be obstructions surrounding the antenna 418, such as trees, houses, and other structures. By directing the antenna substantially perpendicular to the ground (i.e., straight up), the antenna may be better positioned to receive radio signals from and/or transmit radio signals to the balloons.

In another example, the various components of the antenna 418 may be protected from water damage and/or corrosion. For example, the components of the antenna may be wrapped in a protective plastic, sealed with a waterproof sealant, or otherwise designed with water protection.

Further, the device 400 may include a mechanism for re-refilling and/or changing the liquid 416 in the sealed vessel 402. In one example, the mechanism may include a pump configured to empty the liquid 416 from the sealed vessel 402 after a certain period of time, and subsequently refill the sealed vessel 402 with additional liquid. In another example, the device 400 may include a drain at the bottom of the sealed vessel 402 that a user can remove to drain the liquid. Other examples of removing and refilling the liquid 416 from the sealed vessel 402 are possible as well. Such procedures may prevent the components of the antenna 418 from corroding, and prevent mold from forming on the inside of the sealed vessel 402, among other advantages.

Figure 4G:
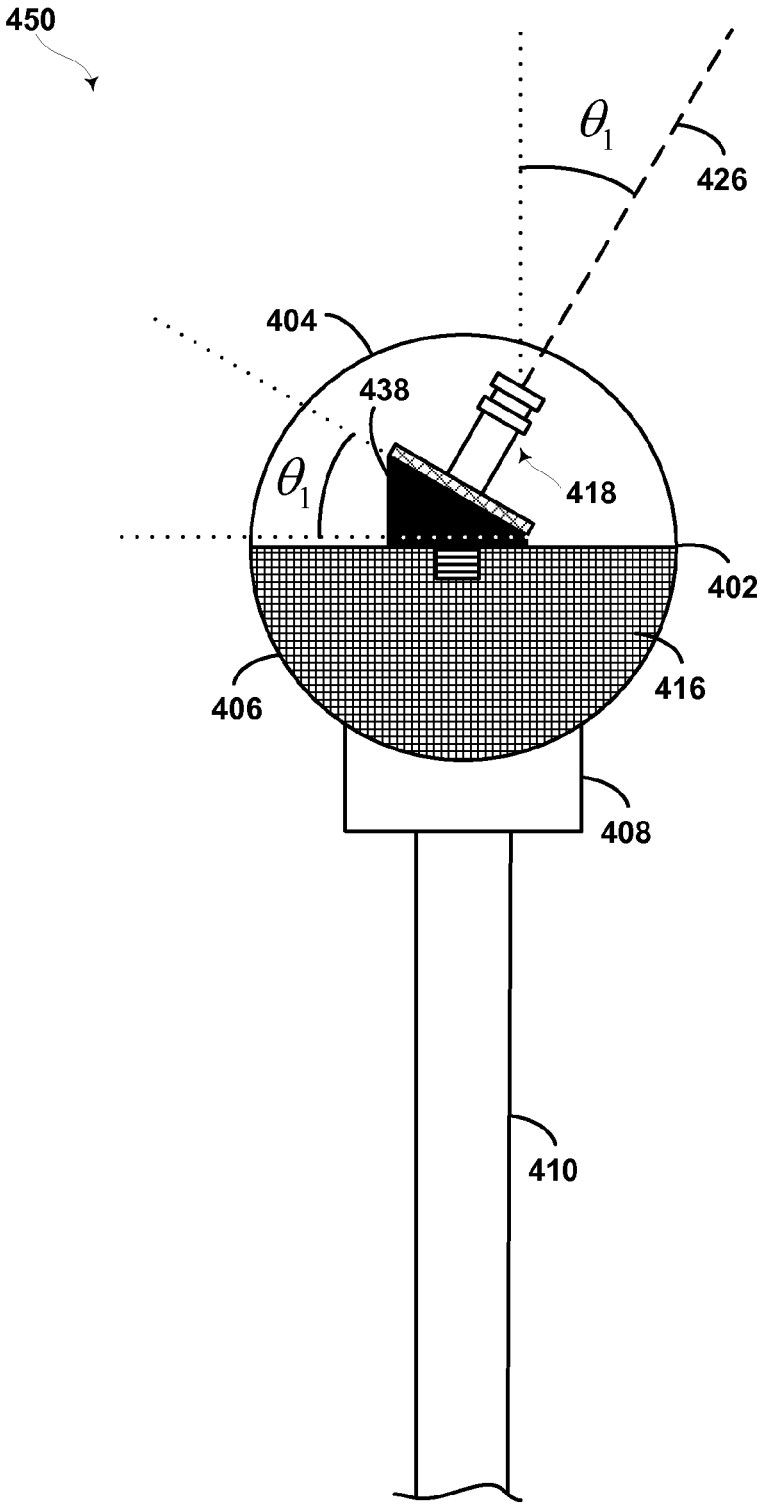
FIG. 4G illustrates a cross-sectional view of another example device for connectivity to a balloon network, according to an example embodiment.

FIG. 4G illustrates a cross-sectional view of another example device 450 for connectivity to a balloon network, according to an example embodiment. The device 450 may be very similar to the device 400 described in FIGS. 4A-4F. However, the device 450 may include an angled floating base 438 coupled to the base of the antenna 418. The angled floating base 438 may include Styrofoam, or some other material that is positively buoyant in the liquid 416. The angled floating base 438 enables the antenna 418 to float on the liquid 416 inside of the sealed vessel 402. The angled floating base 438 has an angle $\theta_1$ with respect to the level of the liquid 416. The angled floating base 438 is configured to position the base of the antenna 438 at the angle $\theta_1$ with respect to the level of the liquid 416, such that the emission pattern 426 of the antenna 418 is at the angle $\theta_1$ with respect to plumb. Plumb is also known as true vertical, or perpendicular to water level. An angled emission pattern 426 may be advantageous if the antenna 418 must be directed at an angle to access a balloon, or if there is an obstruction located directly above the antenna system.

V. EXAMPLES OF METHODS

Figure 5:
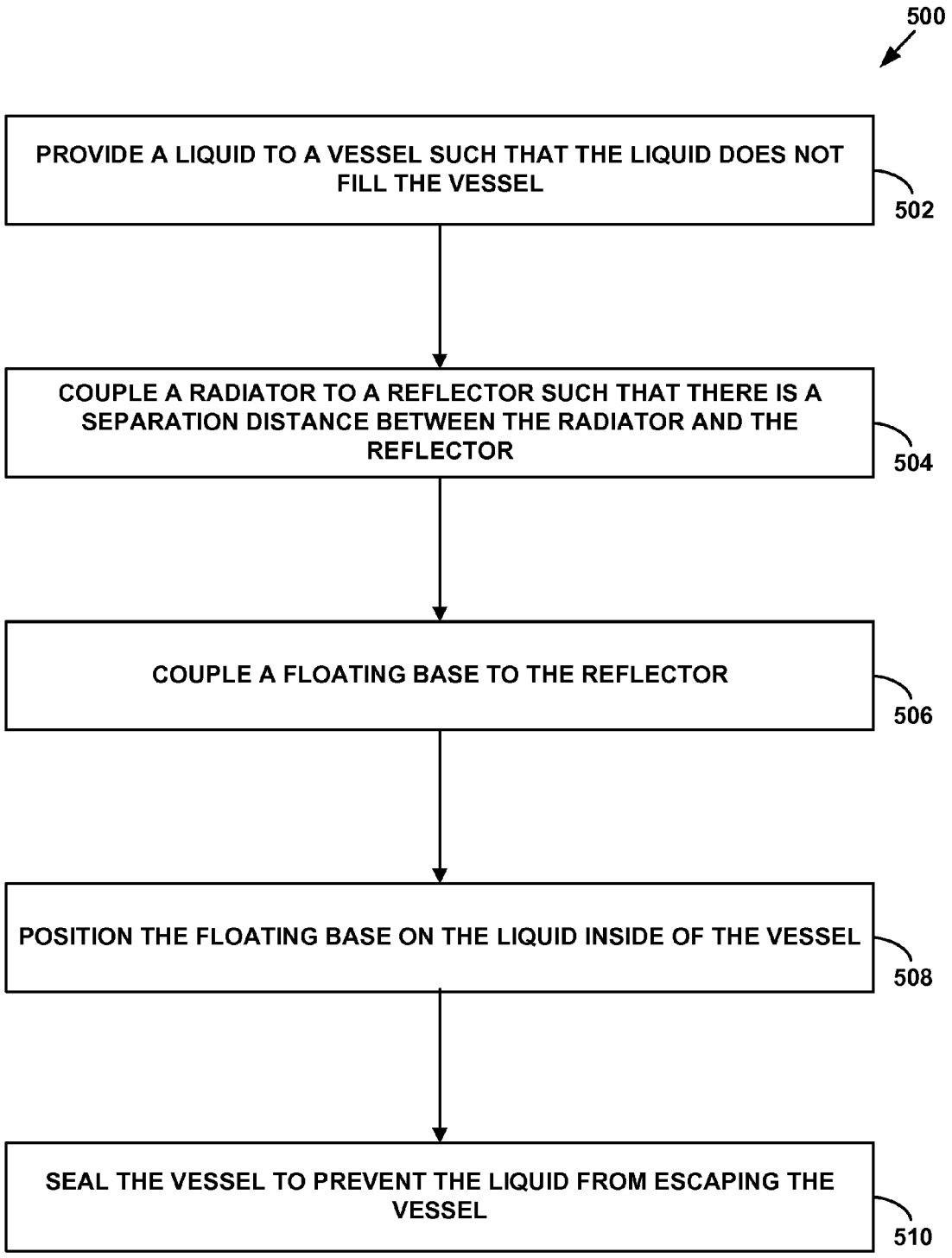
FIG. 5 depicts a flow chart, according to an example embodiment.

FIG. 5 is a simplified flow chart illustrating method 500, according to an exemplary embodiment. Although the blocks are illustrated in a sequential order, these blocks may also be performed in parallel, and/or in a different order than those described herein. Also, the various blocks may be combined into fewer blocks, divided into additional blocks, and/or removed based upon the desired implementation.

At block 502, method 500 involves providing a liquid to a vessel such that the liquid does not fill the vessel. As discussed above, the liquid may be water, mineral oil, or a saline solution as examples. Other potential liquids are possible as well. In one example, the liquid may be provided to a lower portion of the sealed vessel, and then the upper portion of the sealed vessel may be coupled to the lower portion. In another example, the liquid may be provided to the sealed vessel via a hole in the top of the sealed vessel. Other examples are possible as well.

At block 504, method 500 involves coupling a radiator to a reflector such that there is a separation distance between the radiator and the reflector. The radiator may be configured to emit radiation according to input signals (e.g., from a transmitter). The emitted radiation may be characterized by an emission pattern. As a specific example, the radiator may include two FR4 panels. The reflector can be a solid or non-solid (e.g., mesh), and may be spherically invariant dish (e.g., the reflective surface of the dish may be equidistant from a common point, or spherical center). In one example, the reflector may include copper or aluminium. The radiator and reflector may be separated by a separation distance of approximately 75 millimeters. By varying the separation distance between the radiator and the reflector, the emission pattern of the antenna may be adjusted. In one example, a linkage may be configured to adjust the separation distance between the radiator and the reflector.

At block 506, method 500 involves coupling a floating base to the reflector. The floating base may include Styrofoam, or some other material that is positively buoyant. The floating base enables the antenna to float on the liquid inside of the sealed vessel. In one example, the floating base covers the entire base of the reflector. In another example, the floating base includes buoyant material coupled to the perimeter of the reflector. In yet another example, the floating base may be parabolic in shape or v-shaped to enable the antenna to float on the liquid. The floating base may be configured to position the reflector at a non-zero angle with respect to the liquid, such that radiation is emitted from the radiator at the non-zero angle with respect to plumb.

At block 508, method 500 involves positioning the floating base on the liquid inside of the vessel. As discussed above, the floating base positioned on the liquid inside of the vessel ensures that the reflector and radiator are level and that the radiator emits an emission pattern that is perpendicular to the surface of the liquid.

At block 510, method 500 involves sealing the vessel to prevent the liquid from escaping the vessel. The vessel may include an upper portion and a lower portion that can be coupled together to seal the vessel. The upper portion may be coupled to the lower portion via a coupling mechanism, such as a hinge and clasp or some other mechanism. In another example, the edge of the upper portion and the edge of the lower portion may be threaded so that the two portions of the vessel may be coupled by screwing the upper portion into the lower portion. In another example, the upper portion and the lower portion may be press fit together. In yet another example, an adhesive may be used to couple the upper portion to the lower portion. Other examples are possible as well. The sealed vessel protects the other components of the device from exposure to the elements.

VI. CONCLUSION

The above detailed description describes various features and functions of the disclosed systems, devices, and methods with reference to the accompanying figures. While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. A device comprising:

a sealed vessel partially filled with a liquid;

a floating base that is comprised of a first material that is positively buoyant in the liquid, wherein a bottom surface of the floating base is substantially planar;

a weight coupled to the bottom surface of the floating base, wherein the weight is comprised of a second material that is negatively buoyant in the liquid; and an antenna coupled to the floating base, wherein the antenna is configured to receive and emit radiation, wherein the antenna and the floating base are positioned within the sealed vessel, and wherein the floating base is configured to position the antenna such that the antenna emits an emission pattern that is substantially perpendicular to a surface of the liquid.

2. The device according to claim 1, wherein the liquid is one of water, mineral oil, or a saline solution.

3. The device according to claim 1, wherein the floating base is coupled to a perimeter of the antenna.

4. The device according to claim 1, wherein the antenna further comprises:

a radiator configured to emit radiation according to a feed signal; and a reflector coupled to the radiator such that there is a separation distance between the radiator and the reflector, wherein the reflector is configured to direct radiation emitted from the radiator such that reflected radiation is characterized by the emission pattern.

5. The device according to claim 4, wherein the radiator comprises a first panel positioned above a second panel.

6. The device according to claim 5, wherein a separation distance between the first panel and the second panel is less than the separation distance between the radiator and the reflector.

7. The device according to claim 4, wherein the antenna further comprises:

a linkage configured to adjust the separation distance between the radiator and the reflector.

8. The device according to claim 1, wherein the antenna is configured to receive radiation from a region defined by the emission pattern.

9. The device according to claim 1, wherein the antenna is configured to transmit signals to one or more airborne radio stations.

10. The device of claim 1, wherein the antenna extends vertically from a top surface of the floating base, and wherein the weight counterbalances a weight of the vertically extended antenna.

11. A device comprising:

a sealed vessel partially filled with a liquid;

an antenna configured to receive and emit radiation;

a floating base having a first side and a substantially planar second side, wherein the floating base is comprised of a first material that is positively buoyant in the liquid, wherein the first side of the floating base is coupled to the antenna and the second side of the floating base is positioned to float on the liquid inside of the sealed vessel, and wherein the floating base is configured to position a base of the antenna at a non-zero angle with respect to the liquid such that radiation is emitted from the antenna at the non-zero angle with respect to plumb; and a weight coupled to the second side of the floating base, wherein the weight is comprised of a second material that is negatively buoyant in the liquid.

12. The device of claim 11, wherein the antenna further comprises:

a radiator configured to emit radiation according to a feed signal; and a reflector coupled to the radiator such that there is a separation distance between the radiator and the reflector, wherein the reflector is configured to direct radiation emitted from the radiator such that reflected radiation is characterized by an emission pattern.

13. The device of claim 12, wherein the antenna is configured to receive radiation from a region defined by the emission pattern.

14. The device of claim 11, wherein the antenna is configured to transmit signals to one or more airborne radio stations.

15. The device of claim 11, wherein the antenna extends vertically from a top surface of the floating base, and wherein the weight counterbalances a weight of the vertically extended antenna.

16. A method comprising:

providing a liquid to a vessel such that the liquid does not fill the vessel;

coupling a radiator to a reflector such that there is a separation distance between the radiator and the reflector, wherein the radiator is configured to emit radiation according to a feed signal, and wherein the reflector is configured to direct radiation emitted from the radiator such that reflected radiation is characterized by an emission pattern;

coupling a first side of a floating base to the reflector, wherein the floating base is comprised of a first material that is positively buoyant in the liquid;

coupling a second side of the floating base to a weight, wherein the second side is substantially planar, and wherein the weight is comprised of a second material that is negatively buoyant in the liquid;

positioning the floating base on the liquid inside of the vessel; and sealing the vessel to prevent the liquid from escaping the vessel.

17. The method of claim 16, wherein the reflector is substantially parallel to a surface of the liquid such that the emission pattern is substantially perpendicular to a surface of the liquid.

18. The method of claim 16, wherein the floating base is configured to position the reflector at a non-zero angle with respect to the liquid such that radiation is emitted from the radiator at the non-zero angle with respect to plumb.

* * * * *